US005831253A

United States Patent [19]

Han et al.

[11] Patent Number: 5,831,253

[45] Date of Patent: Nov. 3, 1998

[54] METHOD OF CONTROLLING A MICROWAVE OVEN HAVING A VERTICALLY MOVABLE ROTARY TRAY AND FOOD WEIGHT SENSOR

[75] Inventors: Dae-Sung Han; Seok-Weon Hong; Kwang-Seok Kang, all of Suwon, Rep. of Korea

[73] Assignee: Samsung Electronics Co., Ltd., Suwon, Rep. of Korea

[21] Appl. No.: 804,395

[22] Filed: Feb. 21, 1997

[30] Foreign Application Priority Data

Feb. 23, 1996 [KR] Rep. of Korea ..... 1996-4364
Feb. 23, 1996 [KR] Rep. of Korea ..... 1996-4365

[51] Int. Cl.[6] ..... H05B 6/68; H05B 6/78

[52] U.S. Cl. ..... 219/708; 219/685; 219/704; 219/753; 219/762; 99/325

[58] Field of Search ..... 219/685, 702, 219/704, 705, 708, 706, 753, 754, 752, 762, 763, 518; 99/325

[56] References Cited

U.S. PATENT DOCUMENTS 4,615,405 10/1986 Morino et al. .
4,831,239 5/1989 Ueda ..... 219/518
5,360,965 11/1994 Ishii et al. ..... 219/705
5,362,946 11/1994 Matsushima ..... 219/704
5,478,987 12/1995 Morita ..... 219/705

FOREIGN PATENT DOCUMENTS

UM/90-83891 3/1990 Japan .
UM/94-64013 9/1994 Japan .
96-320123 12/1996 Japan .

*Primary Examiner*—Philip H. Leung
*Attorney, Agent, or Firm*—Burns, Doane, Swecker & Mathis, L.L.P.

[57] ABSTRACT

A microwave oven wherein at least a microwave cooking mode and an electric resistance heater cooking mode can be selected by a user. A tray for supporting foodstuff can be raised and lowered and rotated about a vertical axis. A weight measuring mechanism determines the weight of foodstuff on the tray. During a cooking sequence, an operator selects a cooking mode, and the weight of foodstuff is measured. A controller determines a desired cooking elevation as a function of the cooking mode and weight of the foodstuff. A rotation mechanism begins to rotate the tray, and then the rotating tray is raised to the desired elevation, whereupon a cooking operation is performed while the tray is rotated at the desired elevation. At the end of the cooking operation, the tray is lowered to its initial position while still being rotated.

2 Claims, 8 Drawing Sheets

METHOD OF CONTROLLING A MICROWAVE OVEN HAVING A VERTICALLY MOVABLE ROTARY TRAY AND FOOD WEIGHT SENSOR

FIELD OF THE INVENTION

The present invention generally relates to a method of controlling a tray of a microwave oven, wherein the tray is able to be rotated about a vertical axis, as well as raised and lowered.

BACKGROUND OF THE INVENTION

The following description concerns the related arts. Japanese Utility Model Publication (unexamined) No. 94-64013 (filed on Feb. 16, 1993) discloses a microwave oven that includes a cooking chamber, a food-supporting tray, a motor, and a reversible driving means. The driving means passes through the cooking chamber's middle section. The tray is mounted on the floor of the cooking chamber, and is connected to the motor so that it is elevated by the operation of the motor and then caused to rotate. If the motor is reversed, the driving means stops the rotation and moves the tray back down to the initial predetermined position. In this manner, the microwave oven is convenient to use.

U.S. Pat. No. 4,615,405 and Japanese Laid-Open Patent Publication 96-320123 disclose microwave ovens having a weight sensor for sensing the weight of food on a tray disposed in a cooking chamber. U.S. Pat. No. 4,615,405 discloses that the cooking time period is calculated as a function of the sensed food weight.

Japanese Utility Model Publication (unexamined) No. 90-83891 (filed on Mar. 30, 1990) discloses a microwave oven that includes a spin chuck table, a rotatable tray located on the spin chuck table, and a tray elevating device which raises the tray to a prescribed height. When the tray elevating device goes into action, the tray is elevated and becomes disjoined from the spin chuck table. The tray then rotates, and microwaves generated by a magnetron are uniformly transferred to even the bottom of the tray.

A conventional microwave oven will be now described with reference to the accompanying FIG. 7 which depicts a vertical sectional view of the conventional oven. As shown in FIG. 7, the conventional microwave oven includes a metallic cabinet 10, a cooking chamber 11, a magnetron (not illustrated) which emits high-frequency microwaves to the cooking chamber 11, and a high voltage generator 13 which supplies high voltages to the magnetron. A heater 17 is mounted on the upper portion of the cooking chamber 11 to cook foodstuffs in the cooking chamber 11 by radiant heat and convective heat. A food-supporting tray 12 is provided on the floor of the cooking chamber, and is designed to be rotated about a vertical axis, and/or elevated.

The above microwave oven also includes a shaft 31 having an upper end connected with the bottom of the tray 12 and a lower end extending downward to the outside of the cooking chamber 11. Elevation guide member 34 is positioned under the shaft 31 to elevate the shaft 31 and the tray. A motor 32 rotates the shaft 31 by means of a gear 32*a*. A weight sensing portion 35 is provided under the elevation guide member 34 for measuring the weight of foodstuff disposed on the tray 12.

The following description relates to the operation of the above microwave oven.

Generally speaking, if microwaves of about 2,450 MHz in frequency are applied to a food, molecules of the food are motivated by microwave energy so the food emits heat. A microwave oven is an oven that uses microwave heating for fast cooking of meat and other foods.

When the magnetron emits microwaves of about 2,450 MHz into the metallic cabinet 10, molecules of the food are each charged to positive and negative electrons. One side of each of the molecules is negatively charged by the positive electrons of the electric field created by the microwaves, and the other side of each of the molecules is positively charged by the negative electrons of the electric field. Since the electric field's polarity is changed 2.4 billion, 5 thousand times per second, the food's molecules collide with each other to thereby create friction heat so that the food is heated up.

The oven is actually a convection microwave which has a cooking function employing radiant heat and convective heat produced by the electric heater 17. Alternatively, cooking can be performed by the microwave energy.

Foodstuffs put on the tray 12 are to be cooked as the tray 12 rotates about a vertical axis and/or after the tray has been elevated. An elevator motor 33 is provided to move the elevation guide member 34 to the right and left between two positions in order to lower and raise the tray, respectively, in FIG. 7. The microwave oven performs fast cooking of foods either by microwave energy or heat, and the movement of the tray can be performed during either of those cooking operations.

If a user selects grill mode, barbecue mode or pizza-baking mode, by pressing appropriate buttons on an operation panel (not illustrated), the heater 17 is energized, and the guide member 34 is shifted to the FIG. 7 position to elevate the tray 12 to a predetermined height. Then, the tray 12 begins to be rotated, and the cooking is performed. The tray 12, however, is always elevated to the same predetermined height without regard to the selected cooking mode. When the elevation of the tray 12 has been completed, the foodstuff on the tray 12 is cooked by microwave energy generated by the magnetron. Once the cooking operation stops, the tray stops rotating and then descends.

The above-described conventional microwave oven always performs the cooking operation with the tray positioned at the same height, regardless of the user-selected cooking mode and the weight of the food. Thus, the heater does not vary the heating applied to the foodstuff according to the cooking mode, and this microwave oven thus will not perform an optimum cooking function. Furthermore, in case the tray has been elevated with the foodstuff offset to one side of the tray, rather than in the middle of the tray, the center of gravity of the food is offset to that one side so an imbalanced force is applied to the tray's shaft 31 as the tray moves vertically, which may cause a malfunction in the microwave oven, or the oven may fail to operate.

SUMMARY OF THE INVENTION

The present invention involves a method of controlling the driving of a microwave oven tray that can obviate the aforementioned problems and disadvantages of the conventional techniques.

It is an objective of the present invention to provide a method of controlling the driving of a tray for a microwave oven so as to ensure an optimum cooking function by variously setting the elevating height of the tray in accordance with a user-selected cooking mode and the weight of a foodstuff to be cooked.

It is another objective of the present invention to provide a method of controlling the driving of a tray for a microwave oven which can avoid overloading the microwave oven's motor and shaft when its tray is moved up and down.

In order to attain the above-mentioned objectives, the present invention relates to a method of operating a microwave oven, the oven having a cooking chamber for cooking a foodstuff, a microwave generator for supplying microwaves to the cooking chamber, a selector for enabling a user to select from among various cooking modes, a tray disposed in the cooking chamber for supporting the foodstuff, a weighing mechanism for weighing food disposed on the tray, and an elevating mechanism operably connected to the tray for raising and lowering the tray. The method comprises the steps of:

A. obtaining a first cooking parameter by selecting one of the cooking modes;

B. obtaining a second cooking parameter by measuring the weight of the foodstuff after an operation start signal has been input;

C. determining a desired tray elevation as a function of at least one of the parameters; and D. elevating the tray to the desired elevation.

The microwave oven preferably further includes an electric resistance heater for generating convection heat and radiant heat, whereby Step A comprises selecting from among the electric resistance heater and microwave generator to obtain the first parameter.

Preferably, Step C comprises determining the desired tray elevation as a function of both of the first and second parameters.

Another aspect of the present invention relates to a method of operating a microwave oven, the oven comprising a cooking chamber, a microwave generator for supplying microwaves to the cooking chamber, a tray in the cooking chamber for supporting foodstuff, a rotary mechanism for rotating the tray about a vertical axis, and an elevating mechanism for raising and lowering the tray. The method comprises the steps of:

A. actuating the rotary mechanism to rotate the tray;

B. actuating the elevating mechanism for raising the rotating tray from an initial position to a cooking elevation once a predetermined time period elapses after the tray has begun to rotate;

C. performing a cooking operation while continuing to rotate the tray at the cooking elevation;

D. actuating the elevating mechanism to lower the tray to the initial position at the end of the cooking operation, while continuing to rotate the tray; and E. deactivating the rotary and elevating mechanisms.

The microwave oven preferably further includes an electric resistance heater for generating convection heat and radiant heat, a selector for selecting from among the microwave generator and electric resistance heater as cooking modes, and a weight sensor for sensing a weight of foodstuff on the tray. Step B includes determining the cooking elevation as a function of both a selected cooking mode and a weight of the foodstuff.

BRIEF DESCRIPTION OF THE DRAWINGS

The objects and advantages of the invention will become apparent from the following detailed description of preferred embodiments thereof in connection with the accompanying drawings in which like numerals designate like elements and in which.

DETAILED DESCRIPTION OF PREFERRED EMBODIMENTS

Preferred embodiments of the present invention will be described in detail with reference to the accompanying drawings.

Figure 1:
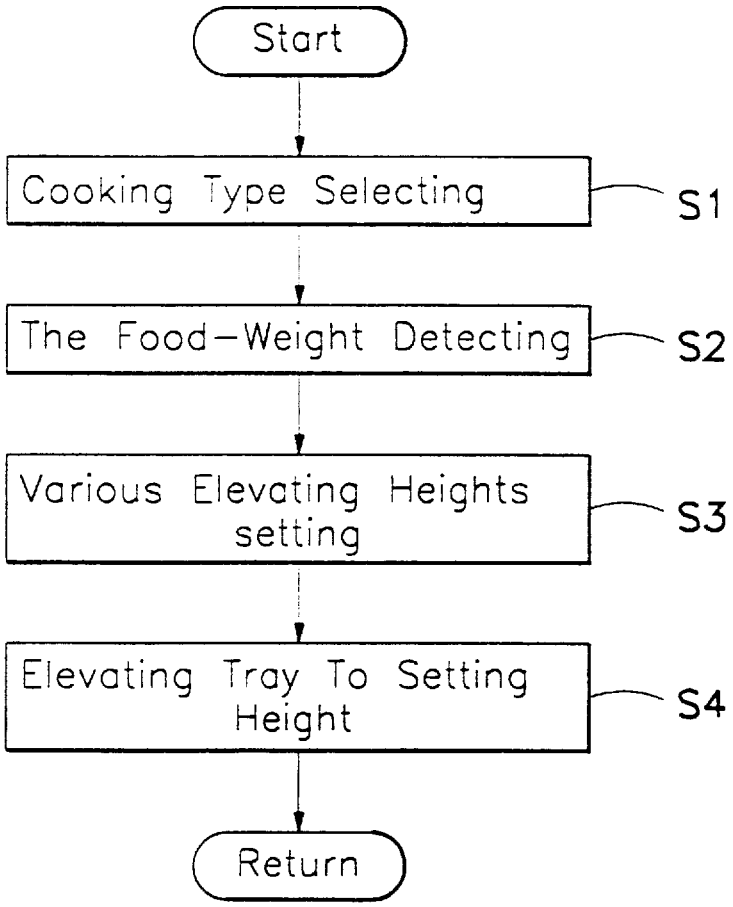
FIG. 1 is a flow chart of a control sequence of a microwave oven in accordance with the present invention.
Figure 2:
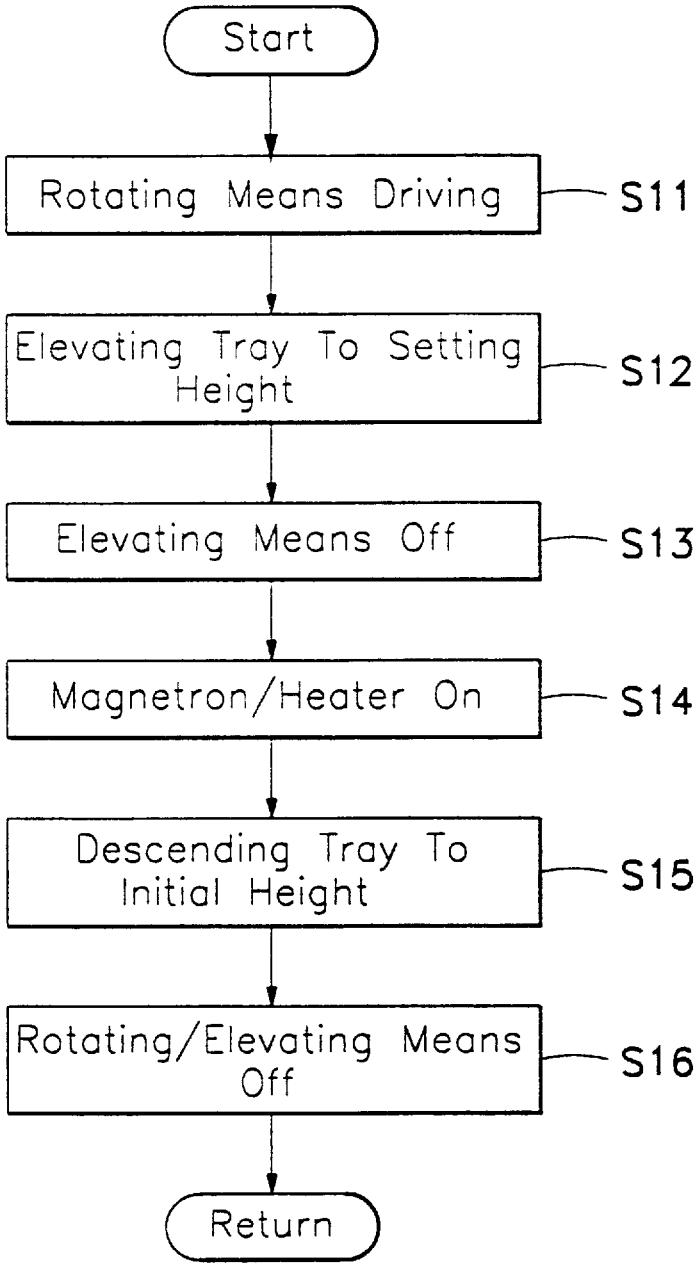
FIG. 2 is a flow chart of a control sequence of the inventive microwave oven for avoiding an overloading of a tray's shaft during elevation/descent of the tray.
Figure 3:
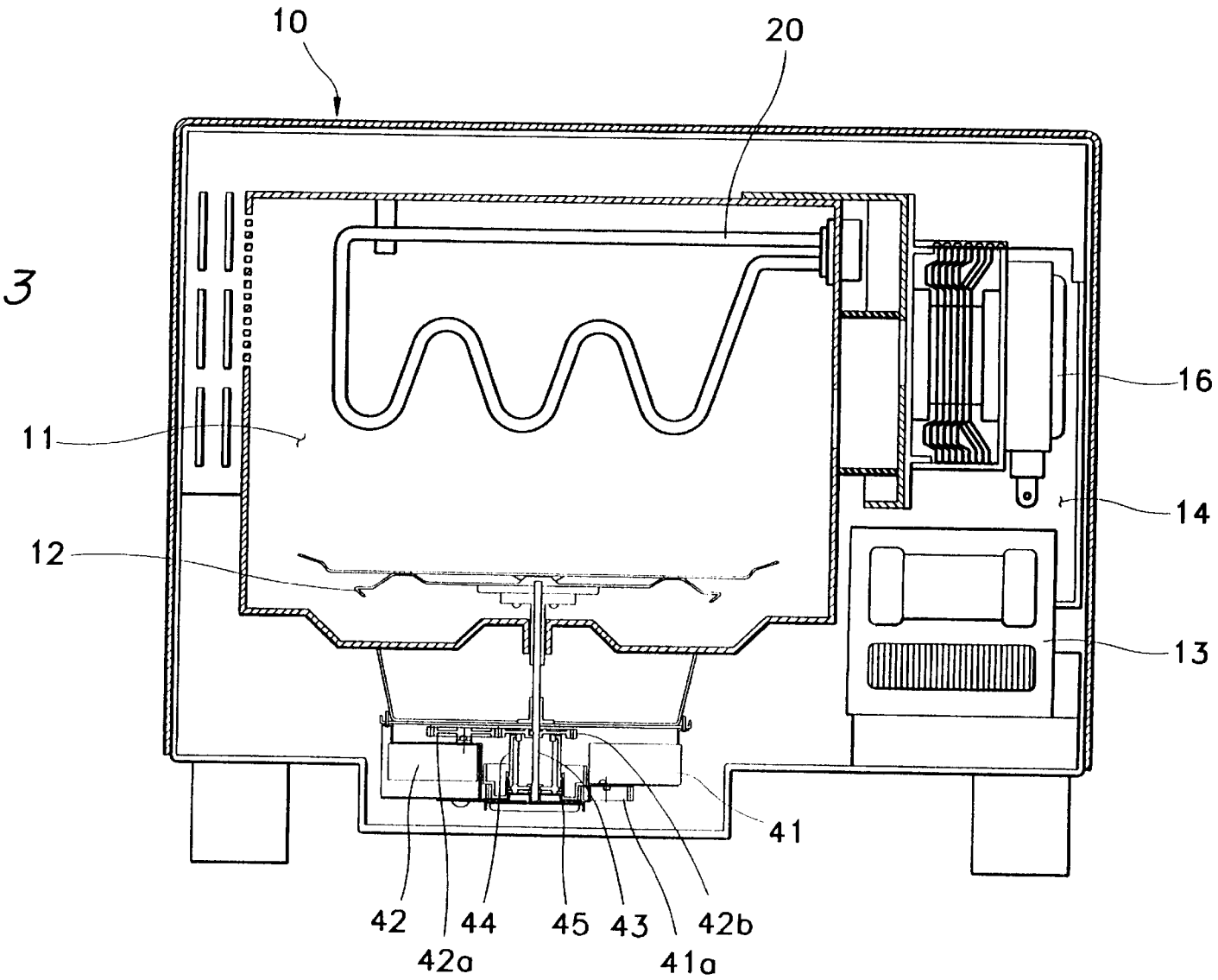
FIG. 3 is a front-sectional view of a microwave oven in accordance with the present invention.

As shown in FIG. 3, a microwave oven includes a cooking chamber 11, a magnetron 16 which is provided in an electrical component compartment 14 to emit high-frequency microwaves to the cooking chamber 11, and a high voltage generator 13 which supplies high voltages to the magnetron 16. An electric resistance heater 20 is mounted on the upper portion of the cooking chamber 11 to cook foodstuffs in the cooking chamber 11 by radiant heat and convective heat. A tray 12 is provided near the floor of the cooking chamber 11, and designed to be rotated about a vertical axis and to be elevated. A foodstuff to be cooked is put on the tray 12.

The above microwave oven also includes a shaft 43 having an upper end connected with the bottom of the tray 12 and a lower end extending downward to the outside of the cooking chamber 11. A motor 42 delivers torque to a rotary gear 42*a* which meshes with a gear 42*b* so as to rotate the shaft 43 and the tray 12. An elevation mechanism 44, actuated by a motor 41, is positioned under the shaft 43.

Figure 3A:
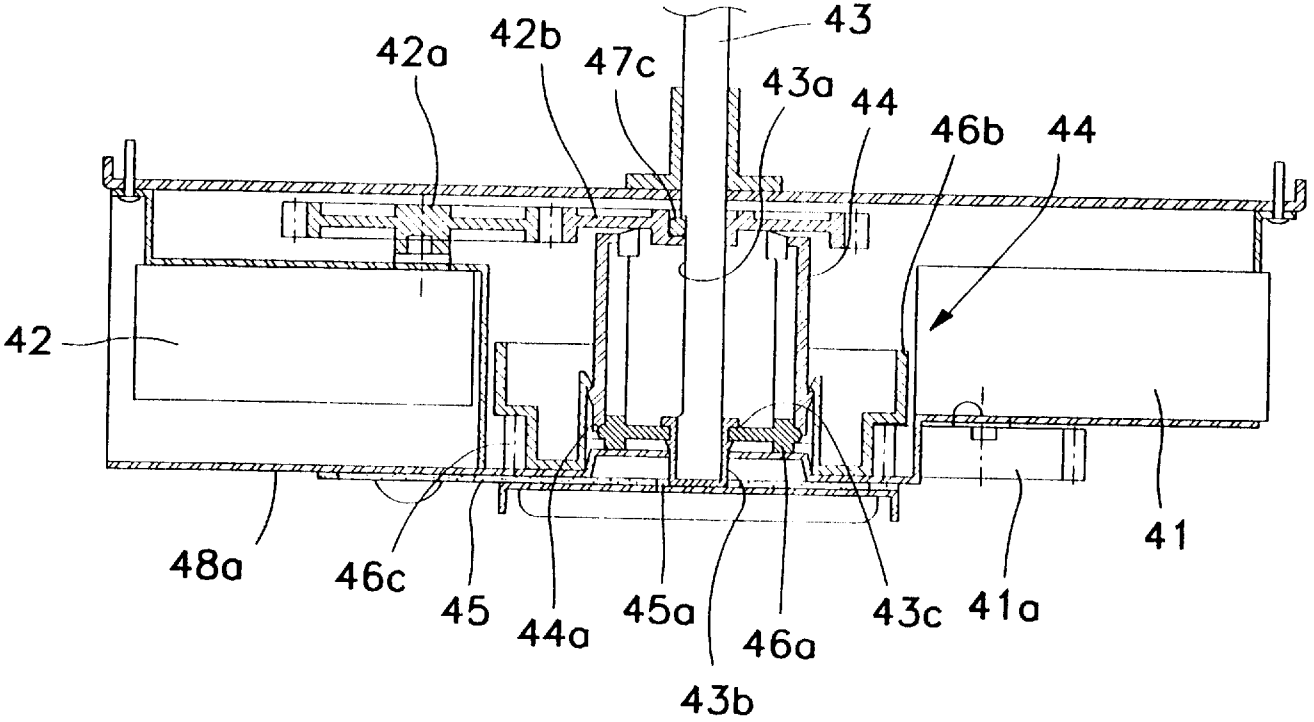
FIG. 3A is a vertical sectional view of an elevation mechanism in the oven according to the present invention.

The elevation mechanism 44 make the various forms, but preferably corresponds to that disclosed in commonly assigned, copending U.S. application Ser. No. 08/664,665, filed Jun. 17, 1996, and now U.S. Pat. No. 5,672,291, the disclosure of which is incorporated herein by reference. That mechanism, depicted in vertical cross section in FIG. 3A, includes a gear element 46*b* mounted for rotation about a vertical axis coinciding with the axis of the shaft 43. The gear element 46*b* includes gear teeth 46*c* which mesh with the teeth of gear 41*a*. An elevator guide member 44 is affixed to the gear element 46*b* to be rotated thereby about the axis of the shaft 43. The guide member 44 includes a cylindrical inner surface having a helical groove 44*a* formed therein. The outer edge of a non-rotatable elevator member 46*a* is mounted in the helical groove. Thus, when the guide member 44 is rotated about the axis of shaft 43 by means of the gear 41*a*, the elevator member 46*a* is caused to rise or descend, depending upon the direction of rotation of the gear 41*a*. A sleeve 43*b* is affixed to the lower end of the shaft 43. That sleeve includes an annular groove 43*c* in which the elevator member 43*a* is mounted, thereby connecting the shaft to the elevator member 46*a* for common vertical movement, while permitting the shaft 43 to rotate relative to the elevator member 46*a*. The shaft 43 includes a vertical slot 43*a*, and a steel ball 47*c* is disposed in the slot so as to be interposed between the gear 42*b* and the shaft 43. Thus, rotation of the gear 42*b* is transmitted to the shaft 43, and the shaft 43 is able to move vertically relative to the gear 42*b*.

The sleeve 43*b* is able to travel through a hole formed in a bottom support plate 48*a* to engage a weight sensing mechanism 45. Any suitable conventional weight sensing mechanism can be utilized, such as that disclosed in the afore-mentioned U.S. Pat. No. 4,615,405 and Japanese Laid-Open Publication 96-320123.

The following description relates to the control circuit of the microwave oven in accordance with the present invention.

Figure 4:
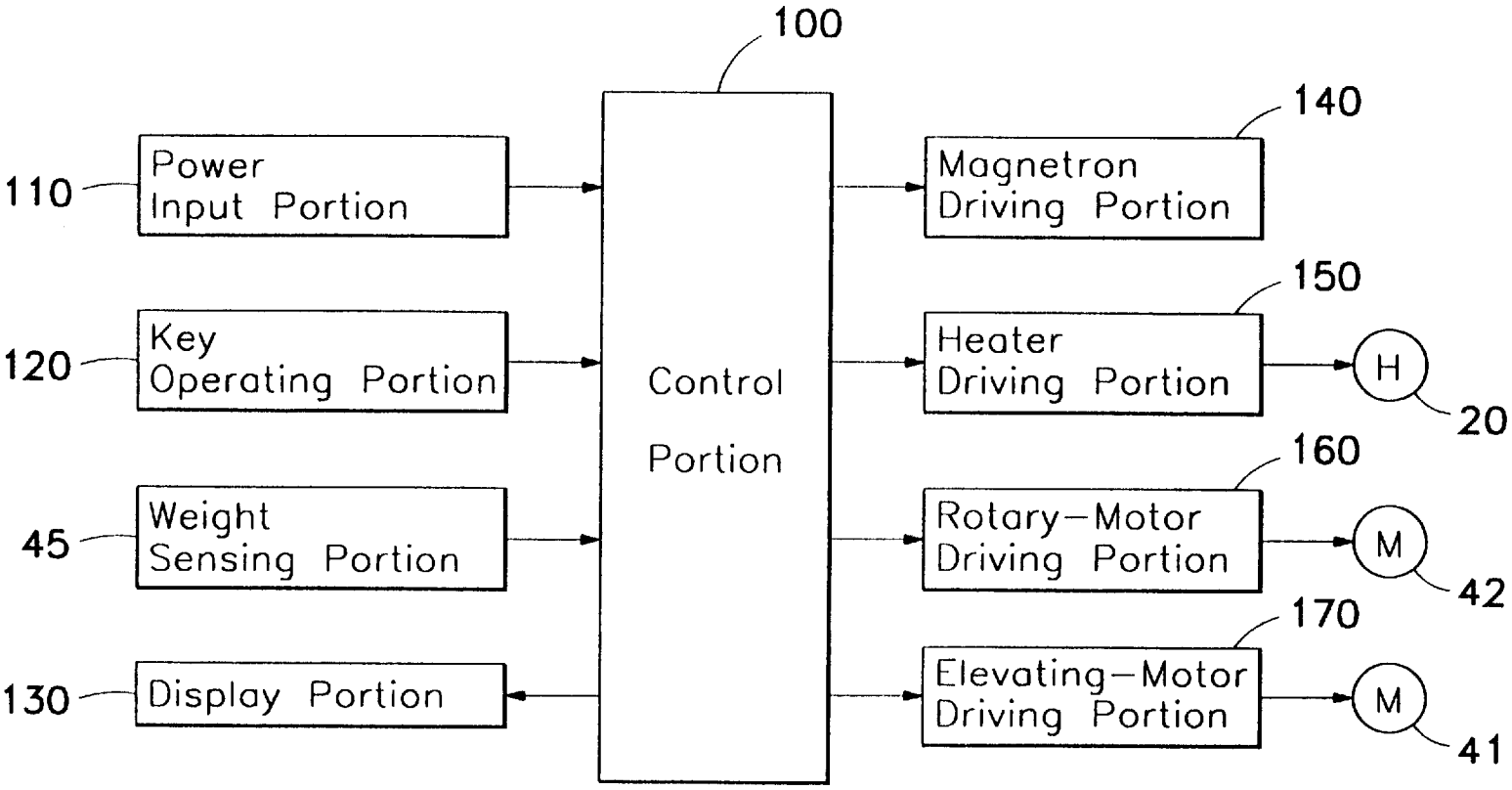
FIG. 4 is a block diagram of a control circuit for a microwave oven in accordance with the present invention.

Referring to FIG. 4, the main control circuit of the microwave oven includes a control portion 100 which controls the overall operation of the microwave oven from the start of cooking to the completion of the cooking, a power input portion 110 which furnishes the control portion 100 with the proper electric voltages and currents for its operation, a key operating portion 120 used to input to the oven a desired cooking mode and cooking time. A display portion 130 displays various messages and cooking conditions during operation, and a heater driving portion 150 which controls the microwave oven's heater 20.

The control circuit of the microwave oven also includes a magnetron driving portion 140 which controls the magnetron 16, an elevating motor driving portion 170 that controls the elevating motor 41 for elevating the tray 12 under the control of the control portion 100, a rotary motor driving portion 160 that controls the operation of the motor 42 for rotating the tray 12, and the weight sensing mechanism 45 which measures the weight of the foodstuff on the tray 12.

Figure 5:
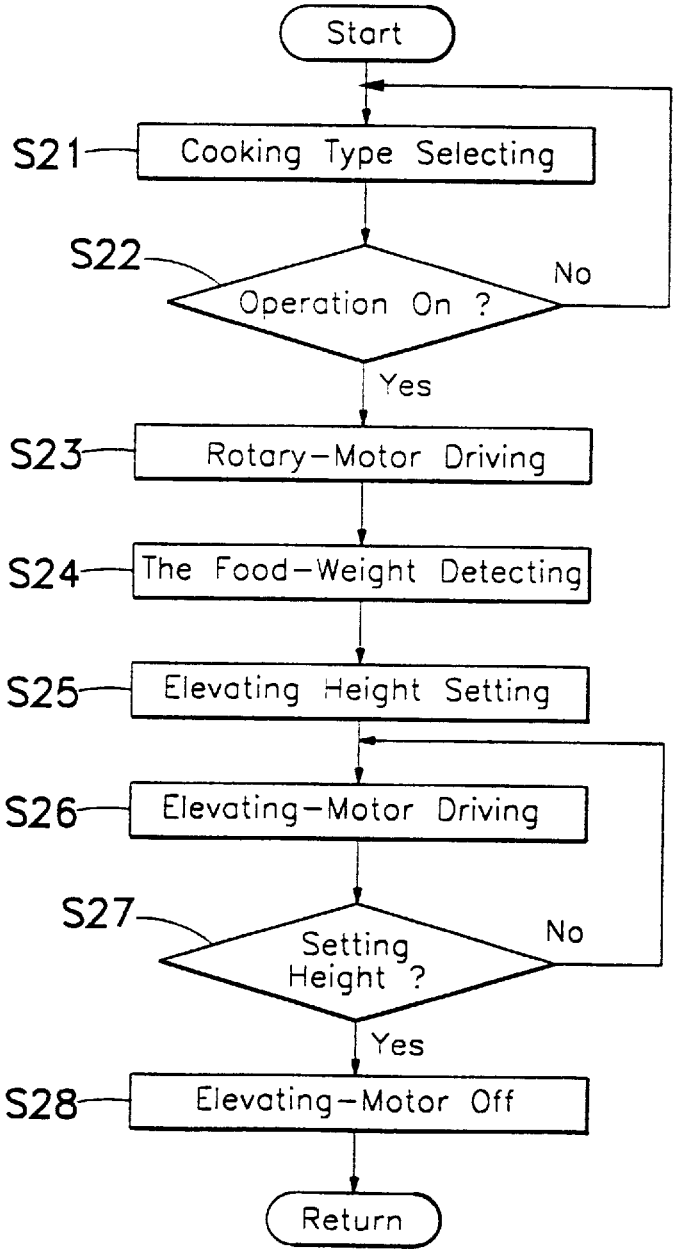
FIG. 5 is a flow chart of one preferred embodiment of a control sequence of a microwave oven in accordance with the present invention.

Referring now to FIG. 5, there is described a first embodiment of a method of controlling the microwave oven. The method includes the steps of selecting one of the cooking modes (S21); determining if a signal of starting operation has been input to the microwave oven (S22); once the operation starts, actuating the motor 42 to rotate the tray (S23); measuring the weight of a foodstuff disposed on the tray 12 (S24); setting an elevating height of the tray 12 in accordance with the selected cooking mode and the weight of the foodstuff (S25); operating the elevating motor 41 to raise the rotating tray (S26) ; determining if the rotating tray 12 has been elevated to the proper preset elevating height (S27) ; and, if so, de-energizing the elevating motor 41 (S28). Cooking then proceeds as the tray continues to be rotated.

The following description concerns a second embodiment of a method of controlling the microwave oven, especially for avoiding an overloading of the shaft 43 during elevation/descent of the tray 12.

Figure 6:
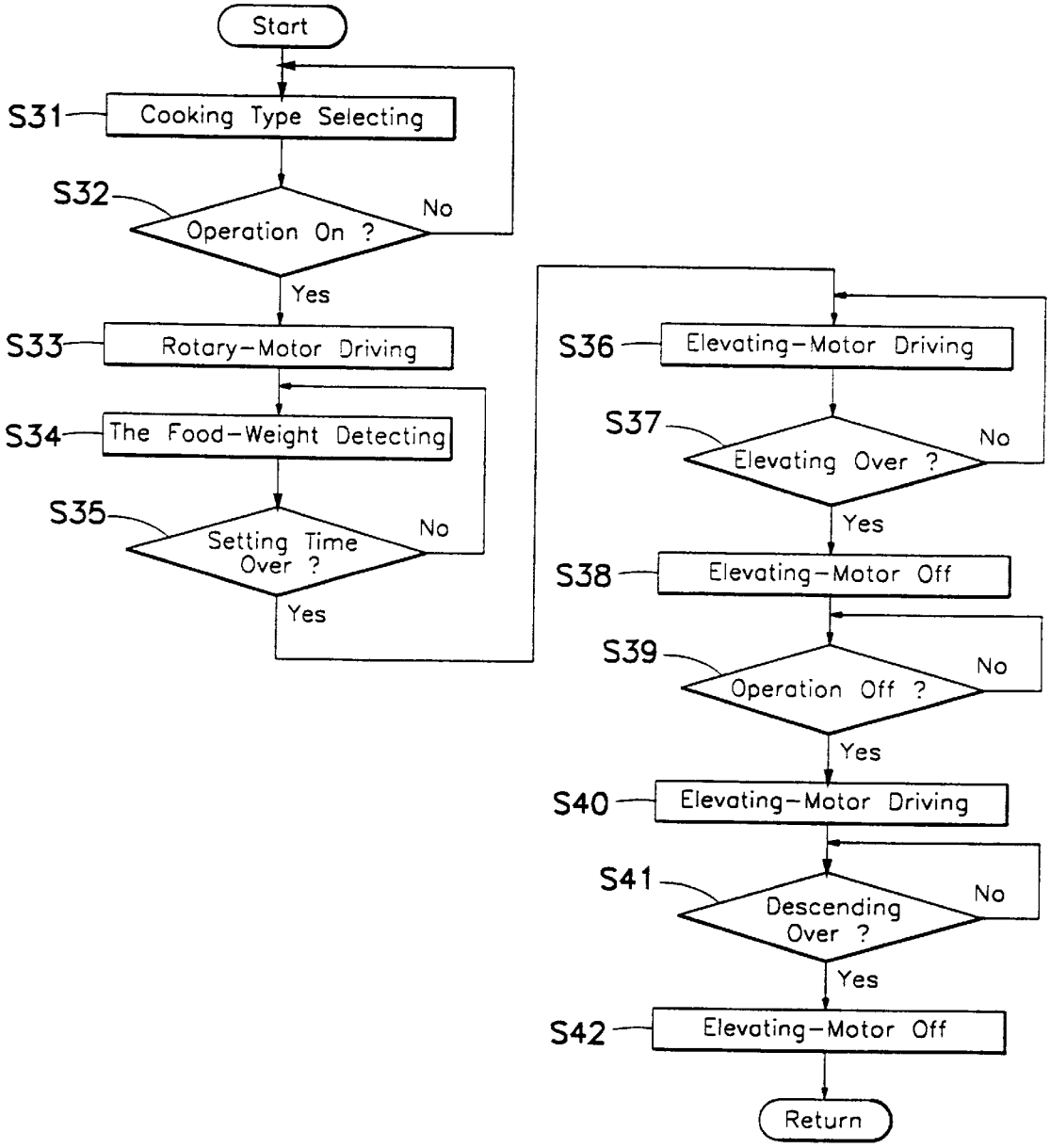
FIG. 6 is a flow chart of another preferred embodiment of a control sequence of the microwave oven for avoiding the overloading of a tray's shaft during elevation/descent of the tray in accordance with the present invention.
Figure 7:
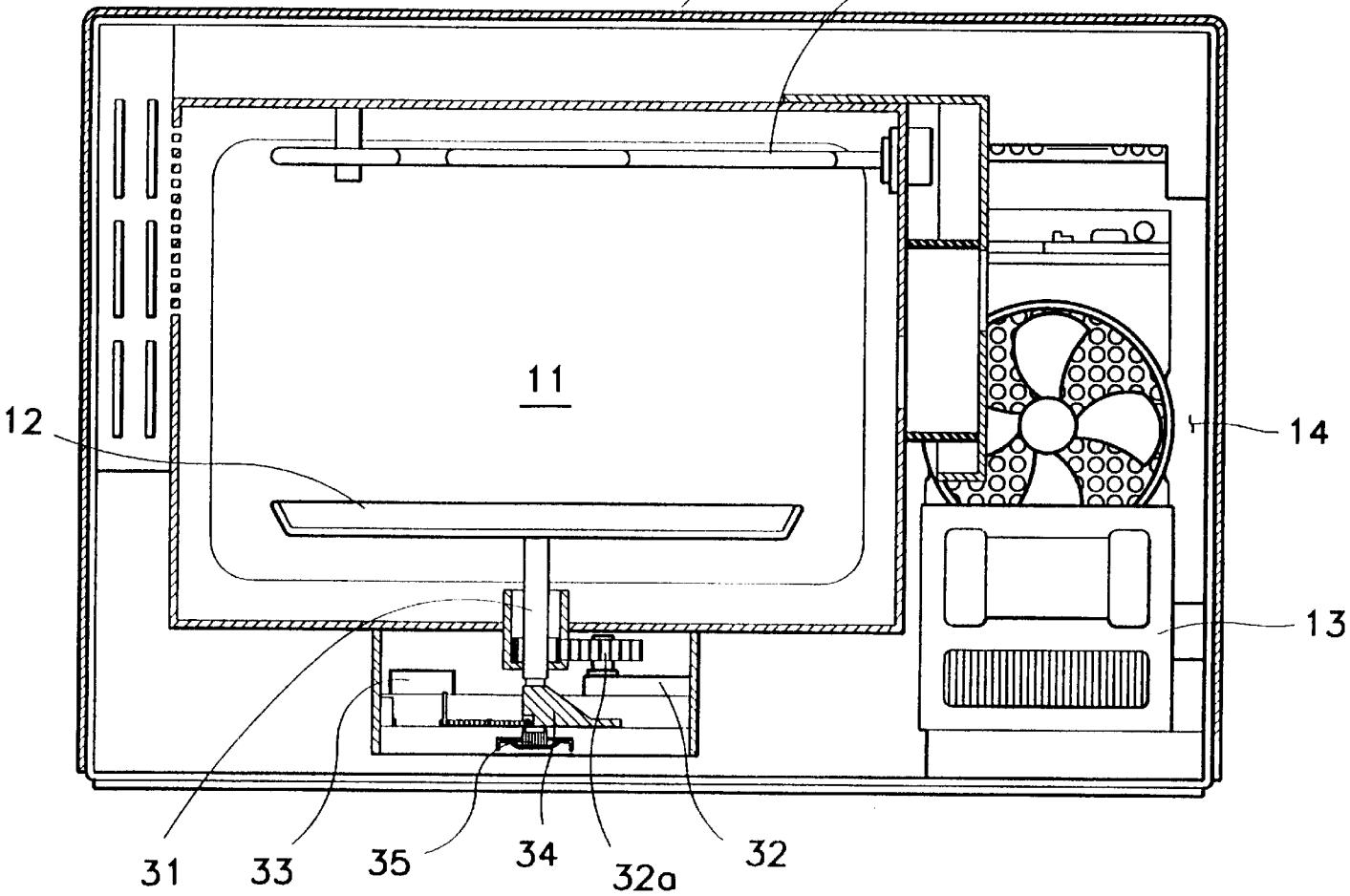
FIG. 7 (PRIOR ART)
FIG. 7 is a front-sectional view of a conventional microwave oven.

Referring to FIG. 6, the method includes the steps of selecting one of the cooking modes (S31); determining if a signal of starting operation has been input to the microwave oven (S32); once the operation starts, actuating the motor 42 to rotate the tray (S33); measuring the weight of a foodstuff put on the tray 12 (S34) ; determining if a predetermined period of time has elapsed (S35); and once the predetermined period of time has elapsed, actuating the elevating motor 41 to elevate the rotating tray 12 to a prescribed height according to the cooking mode and food weight (S36).

The above method of FIG. 6 also includes the steps of determining if the rotating tray 12 has been completely elevated to the prescribed height (S37); de-energizing the motor 41 and performing a cooking operation by high-frequency microwaves and/or heat once the tray 12 (which continues to rotate) has been completely elevated to the prescribed height (S38); determining if the cooking operation is over (S39); operating the elevating motor 41 so as to lower the rotating tray 12 when the cooking operation is over (S40) ; determining if the elevating motor 41 has returned the tray 12 to the initial position (S41); and de-energizing the elevating motor 41 and the motor 42 once the tray has descended completely.

The operation of the rotation and elevating mechanisms of the present invention will now be generally described.

Foodstuffs to be cooked are placed on the tray 12. The weight sensing mechanism 45 measures the weight of a foodstuff on the tray by the pressing of the shaft 43. That is, when the shaft 43 is moved down to the lowest position, the weight sensing mechanism 45 compares a preset standard frequency with the frequency of an output signal currently produced by the weight sensing mechanism and determines a difference therebetween to measure the weight of the foodstuff on the tray 12. The motor 42 delivers torque to the rotary gears 42*a*, 42*b* for rotating the shaft 43 so as to turn the tray 12. The elevating motor 41 actuates the gear 41*a* to rotate the guide member 44 and thereby raise the elevator member 46*a*. The upward movement of the elevator member 46*a* is transmitted to the shaft 43 so that the shaft and tray, which are rotating relative to the elevator member, are raised.

By rotating the tray as it is being raised or lowered, any offset force applied to the tray and shaft due to the effective weight of the food being located at a distance from the center of the tray, will be continually displaced about the axis of rotation, rather than being concentrated in a single location, so malfunctions occurring in the case of trays which do not rotate while being raised or lowered, can be avoided.

The control sequence according to the embodiment of FIG. 4 will now be described in detail.

First, once power is applied to the microwave oven, a user puts a foodstuff to be cooked on the tray 12 inside of the cooking chamber 11, and then selects one of the cooking modes (S21).

Second, the control portion 100 determines (S22) if a signal of starting operation has been input to the microwave oven, i.e., if operation is "on". If the operation is "off", the control portion 100 returns to Step 21.

Third, if the operation is "on", control portion 100 actuates the rotary motor 42 to rotate the tray 12. Simultaneously with this, the heater 20 and/or the magnetron 16 goes into action according to the selected cooking mode. For example, if the user selects a warming or thawing mode, the magnetron 16 goes into action, and if a baking or grill mode is selected, the heater 20 goes into action. In an oven-grill mode, the magnetron 16 and the heater 20 are actuated at the same time.

Fourth, the weight of the foodstuff on the tray 12 is measured (S24). In other words, the load of the foodstuff is transmitted to the weight sensing mechanism 45 during operation of the rotary motor 42, e.g. for about 10 seconds. There is a change in frequency of the output signal of the weight sensing mechanism 45 since the shaft 43 presses against a part of the weight sensing mechanism 45. At this point, the control portion 100 measures the weight of the foodstuff, using the difference between the preset standard frequency and the frequency of the output signal of the weight sensing mechanism 45.

Fifth, a proper elevating height of the tray 12 is determined (S25) in accordance with the selected cooking mode and the weight of the foodstuff. More specifically, a proper height of the tray 12 at which the foodstuff on the tray 12 is cooked optimally is set for the selected cooking mode and the measured weight of the foodstuff. In that regard, a controller stores a preset cooking elevation for each cooking mode and then modifies that elevation depending upon the measured weight of food. For example, when it comes to baking a pizza, the tray 12 could be elevated by 10 mm from its initial position in order that the pizza is cooked to a highly delicious and palatable state.

Sixth, the control portion 100 actuates the elevating motor 41, once the desired elevating height of the tray 12 has been determined. The elevating motor 41 operates to rotate the guide member 44 and thereby raise the elevator member 46*a,* whereby the shaft 43 is elevated to raise the tray 12 to the set height.

Seventh, the control portion 100 determines (S26) if the rotating tray 12 has been elevated to the preset height. If the tray 12 is not moved up to the preset height, the control portion 100 returns to Step 26. If the tray 12 has been completely elevated to the preset height, the control portion 100 de-energizes (S28) the elevating motor 41.

The height to which the tray 12 is raised can be regulated by pre-determining the distance by which the tray 12 is elevated per second during operation of the elevating motor 41 (i.e., by pre-calculating the linear speed of the shaft 43). For instance, if it is known that the shaft travels 1.41 mm/sec., it can be calculated that in order to elevate the tray 12 by 10 mm from its initial position, the elevating motor 41 must operate for 7.1 seconds. Accordingly, during the elevating step the control portion 100 determines if the elevating motor 41 has been operating for 7.1 seconds. If so, then the control portion 100 de-energizes the elevating motor 41 to stop the elevation of the tray 12.

As further examples, a tray could be elevated to 5 mm or 15 mm from its original position in other cooking modes, when an elevating motor 41 operates for 4.15 or 9.38 seconds, respectively.

Referring to FIG. 6, the control sequence for avoiding overloading the tray's shaft during elevation/descent of the tray 12 will be now described in detail.

First, once power is applied to the microwave oven, a user puts a foodstuff to be cooked on the tray 12 inside of the cooking chamber 11, and then selects one of the cooking modes (S31).

Second, the control portion 100 determines (S32) if a signal of starting operation has been input to the microwave oven and whether the operation is "on". When the operation is not "on", the control portion 100 returns to Step 31.

Third, if the operation is "on", the control portion 100 (S33) actuates the magnetron 16 and/or the heater 20 depending upon the selected cooking mode. Simultaneously, the control portion 100 outputs a control signal to the rotary motor driving portion 160 to thereby rotate the tray 12.

Fourth, the weight of the foodstuff on the tray 12 is measured (S34). More specifically, the weight sensing portion 45 measures the weight of foodstuff on the tray 12 for a predetermined period of time after the initial rotation of the tray 12. The operating time of the magnetron 16 and/or the heater 20 is adjusted in accordance with the measured weight of the foodstuff and the selected cooking mode, as explained earlier herein.

Fifth, the control portion 100 determines (S35) if a predetermined time period associated with the selected cooking mode has elapsed. When that time period has not elapsed, the control portion 100 returns to Step 34. When the control portion 100 determines (S35) that the time period has elapsed, the control portion 100 actuates the elevating motor 41 (S36) so that the rotating tray 12 is elevated to a predetermined height. In other words, the proper elevating height of the tray 12 is calculated according to the cooking mode and the weight of the foodstuff. The tray 12 continues rotating while rising to the calculated height.

Sixth, the control portion 100 determines (S37) if the tray 12 has been elevated to the pre-set height by comparing the time period of operation of the motor 41 with a reference value, as explained earlier herein. When the tray 12 has not yet been elevated to the pre-set height, the control portion 100 returns to Step 36. When the tray 12 has been completely elevated to the pre-set height, the control portion de-energizes the elevating motor 41 to stop the further elevation of the tray 12 (S38), and the cooking operation is carried out by using the high-frequency microwaves and/or heat. During the cooking operation, the tray continues to be rotated, so the magnetron's microwave energy and the heater's heat are evenly and thoroughly applied to the entire foodstuff on the tray 12.

Seventh, the control portion 100 determines (S39) if there is a signal for stopping the cooking operation. If so, then the control portion 100 actuates (S40) the elevating motor 41 to lower the rotating tray 12 to the initial position.

Eighth, the control portion 100 determines (S41) whether or not the tray 12 has been completely lowered to the initial position. If the tray 12 has not descended completely to the initial position, the control portion 100 returns to Step 40.

More specifically during step S39, once a signal for stopping the cooking operation is input to the oven during the operation of the magnetron 16 and/or heater, i.e., if either the cooking time has elapsed, or there is a keyboard input for cancelling the cooking, the control portion 100 drives the elevating motor 41 in the opposite direction so as to move the tray 12 down. At this point, the tray 12 descends, while rotating, so the microwaves and/or convection or radiant heat is uniformly distributed to the food.

Ninth, when the elevating motor 41 has lowered the tray to the initial position, the control portion 100 de-energizes (S42) the elevating motor 41, the rotary motor 42, the magnetron 16 and the heater 20.

As described above, according to the present invention, the height of the tray is set in accordance with a user-selected cooking mode and the weight of a foodstuff to be cooked, so that the microwave energy can be evenly and thoroughly applied to the foodstuff on the tray, thereby enhancing the cooking function. During raising and lowering of the tray, the tray continues rotating, which resists overloading the tray's shaft and motor (and also applies the microwave energy evenly to the foodstuff), even when the weight of the food is offset from the center of the tray. That is, the offset force is displaced around the axis of rotation rather than being concentrated at a single location as would occur if the shaft were raised or lowered without being rotated. In this manner, the present invention provides an improved cooking function.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A method of operating a microwave oven having a cooking chamber for cooking a foodstuff, a microwave generator for supplying microwaves to the cooking chamber, a selector for enabling a user to select from among various cooking modes, a tray disposed in the cooking chamber for supporting the foodstuff, a rotary mechanism for rotating the tray about a vertical axis, a weighing mechanism for weighing food disposed on the tray, and an elevating mechanism operably connected to the tray for raising and lowering the tray, the method comprising the steps of:

A) obtaining a first cooking parameter by selecting one of the cooking modes;

B) obtaining a second cooking parameter by measuring the weight of the foodstuff after an operation start signal has been input;

C) determining a desired tray elevation as a function of the first and second parameters;

D) elevating the tray to the desired elevation while rotating the tray about the vertical axis;

E. performing a cooking operation while rotating the tray at the cooking elevation; and F. actuating the elevating mechanism to lower the tray to the initial position at the end of the cooking operation, while rotating the tray.

2. The method according to claim 1 wherein the microwave oven further includes an electric resistance heater for generating convection heat and radiant heat, step A comprising selecting from among the electric resistance heater and microwave generator to obtain the first parameter.

* * * * *